US006264450B1

(12) United States Patent
Woodruff

(10) Patent No.: US 6,264,450 B1
(45) Date of Patent: Jul. 24, 2001

(54) FLEXIBLE VANE PUMP

(76) Inventor: Keith F. Woodruff, 1331 Summit La., Mountainside, NJ (US) 07092

( * ) Notice: Subject to any disclaimer, the term of this patent is extended or adjusted under 35 U.S.C. 154(b) by 0 days.

(21) Appl. No.: 09/482,652

(22) Filed: Jan. 13, 2000

(51) Int. Cl.[7] ..... F01C 5/00

(52) U.S. Cl. ..... 418/153; 418/154; 418/156; 418/259; 415/141; 415/140; 416/240; 416/134 R; 416/135

(58) Field of Search ..... 418/153, 154, 418/156, 259; 415/141, 140; 416/240, 134 R, 135

(56) References Cited

U.S. PATENT DOCUMENTS

| | | | | |
|---|---|---|---|---|
| 1,426,954 | * | 8/1922 | Brooks | 416/240 |
| 2,442,783 | * | 7/1948 | Senn | 416/240 |
| 2,455,194 | * | 11/1948 | Rumsey | 418/154 |
| 2,766,964 | * | 10/1956 | Almquist et al. | 415/141 |
| 2,899,902 | * | 8/1959 | Bandli et al. | 416/240 |
| 3,053,190 | * | 9/1962 | Carlson | 418/154 |
| 3,164,098 | * | 1/1965 | Sully | 418/154 |
| 3,886,764 | * | 6/1975 | Edwards | 418/225 |
| 4,032,270 | * | 6/1977 | Sheth et al. | 418/238 |
| 4,392,779 | * | 7/1983 | Bloemers et al. | 418/154 |
| 4,462,755 | * | 7/1984 | Ogle et al. | 416/132 R |
| 4,863,344 | * | 9/1989 | Stefanni | 418/153 |

FOREIGN PATENT DOCUMENTS

| | | | | |
|---|---|---|---|---|
| 58-124081 | * | 7/1983 | (JP) | 418/156 |

* cited by examiner

*Primary Examiner*—Thomas Denion
*Assistant Examiner*—Theresa Trieu
(74) *Attorney, Agent, or Firm*—Mark P. Stone

(57) ABSTRACT

A pump has a rotor with two or more flexible vanes forming one or more compartments between adjacent vanes. The rotor is mounted offset relative to a rotor sleeve such that the volume of the compartments varies as the rotor rotates in the sleeve. Incoming fluid is supplied to the compartments along a plane perpendicular to the plane of rotation of the vanes. Fluid is discharged from the compartments through discharge slots in the sleeve leading into a discharge outlet which is tangential relative to the plane of rotation of the vanes. Each flexible vane is formed from at least two thin leaf springs separated by a layer of laminate and joined to a shoe which engages the inner surface of the sleeve as the rotor rotates. The pump in accordance with the present invention is energy efficient and uses significantly less power than comparable known devices.

19 Claims, 3 Drawing Sheets

FLEXIBLE VANE PUMP

BACKGROUND OF THE INVENTION

The present invention is directed to improvements to pumps, and in particular, pumps having flexible or resilient vanes extending from a rotor for engaging a rotor sleeve as the rotor rotates within the sleeve during operation of the pump.

Known flexible vane pumps exhibit several disadvantages. Among other things, operation of the known devices requires a relatively large input power supply thereby rendering the known devices energy inefficient. Additionally, the arrangement and components of the rotor assembly, and in particular, the flexible vanes of the known devices are subject to wear thereby limiting the useful operating life of the rotor and requiring replacement at a relatively frequent interval.

It is the primary object of the present invention to overcome the disadvantages of the known devices. In accordance with the preferred embodiments of the present invention, a pump is provided which is energy efficient and which has a useful life greater than that of the known flexible vane pumps. Other advantages of the pump will become apparent from the following description thereof, in conjunction with the drawings.

SUMMARY OF THE INVENTION

A flexible vane pump includes a rotor having a central axis and a plurality of flexible or resilient vanes extending radially outwardly from the rotor. The rotor is mounted for rotation within a cylindrical sleeve, and the ends of the flexible vanes engage the inner surface of the sleeve as the rotor rotates. A plurality of compartments are defined between pairs of adjacent flexible vanes, and the central axis of the rotor is offset relative to the central axis of the sleeve so that the volume of the compartments defined between adjacent flexible vanes varies as the rotor rotates within the sleeve. A plurality of fixed vanes also extend outwardly from the rotor and are arranged so that at least one fixed vane extends into each compartment defined between each pair of adjacent flexible vanes. The remote end of each fixed vane terminates before it engages against the inner surface of the sleeve to avoid contact with the sleeve as the rotor rotates. The fixed vanes provide structural support for the ends of the flexible vanes proximate to the central axis of the rotor and also enhance the flow of incoming fluid into the compartments defined between adjacent flexible vanes.

Inlet means for supplying fluid to the rotor assembly are coupled to an inlet end of the rotor sleeve such that incoming fluid flows along a plane which is substantially perpendicular to the plane of rotation of the rotor. In this manner, the compartments defined between the adjacent flexible vanes are quickly and efficiently filled with the incoming fluid. The rotor axis is outwardly tapered in a direction away from the inlet end, and this arrangement also enhances the efficient filling of the compartments with incoming fluid while expending relatively less energy to do so. The fixed vanes extending from the rotor further enhance the quick and efficient loading of the compartment with fluid by propelling incoming fluid rearwardly into each respective compartment so that subsequent incoming fluid is met with less resistance. The fluid inlet means coupled to the inlet end of the rotor sleeve include an inlet slot which permits incoming fluid to be received only at a predetermined area of the rotor sleeve at which the compartments defined between adjacent flexible vanes are contracted into their smallest volume. As the rotor rotates in the sleeve, the rotor compartment expands in volume to thereby create a partial vacuum causing additional fluid to be drawn into the compartment as the compartment continues to rotate across the inlet slot in the fluid inlet means. As each compartment passes the end of the inlet slot, it becomes sealed and begins to contract in volume, as a result of the offset orientation between the rotor axis and the sleeve, as the sealed compartment rotates towards an outlet means. The inner surface of the sleeve defines at least one slot in communication with the outlet means which is oriented tangentially to the direction of rotation of the rotor. The interaction between the contracted sealed compartment, the discharge slot defined in the inner surface of the sleeve, and the tangential outlet opening in communication with the slot, results in the efficient discharge of fluid from the compressed sealed compartment as it rotates across the tangential discharge means. The compartment now continues to rotate in a direction towards the inlet means where it is again filled with incoming fluid and the cycle repeats. The structural arrangement and cooperation of structure of the rotor, the sleeve, and the inlet and outlet means results in efficient loading and unloading of fluid, thereby decreasing the energy required to operate the pump.

In a further aspect of the invention, the flexible vanes of the rotor are formed from separate components joined together which include at least two leaf springs and at least one laminate surface separating the leaf springs. Each vane also has a shoe element joined to the leaf springs and the laminate and oriented so that the outer surface of the remote end of the shoe engages the inner surface of the rotor sleeve when the rotor rotates within the sleeve. The use of flexible vanes comprising a plurality of leaf springs, preferably of different lengths, joined together and separated by a layer of laminate, reduces stress and wear that would otherwise occur if each vane were formed from a single thicker spring. Accordingly, the flexible vanes in accordance with the present invention extend the useful operating life of the rotor, and reduce the frequency of rotor replacement.

The cooperating structure and arrangement of components of the device in accordance with the present invention results in a flexible vane pump which requires less energy to operate than comparable conventional pumps, and which has a useful operating life exceeding that of conventional pumps.

DESCRIPTION OF THE BEST MODES FOR CARRYING OUT THE INVENTION

FIGS. 1–4 illustrate a flexible vane pump in accordance with the preferred embodiment of the present invention.

Figure 1:
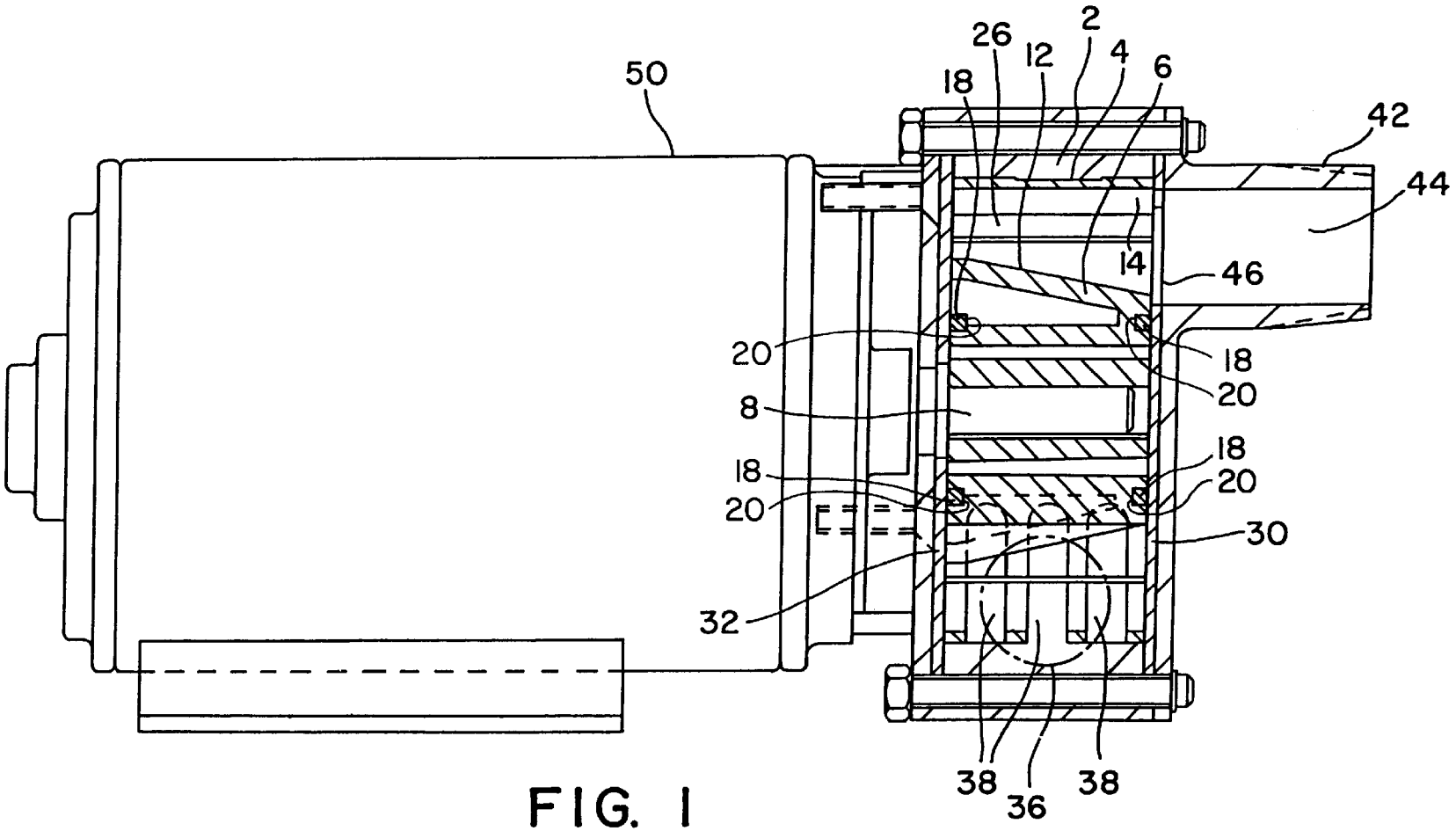
FIG. 1 is a side elevational view, in section, of a pump in accordance with the present invention.
Figure 2:
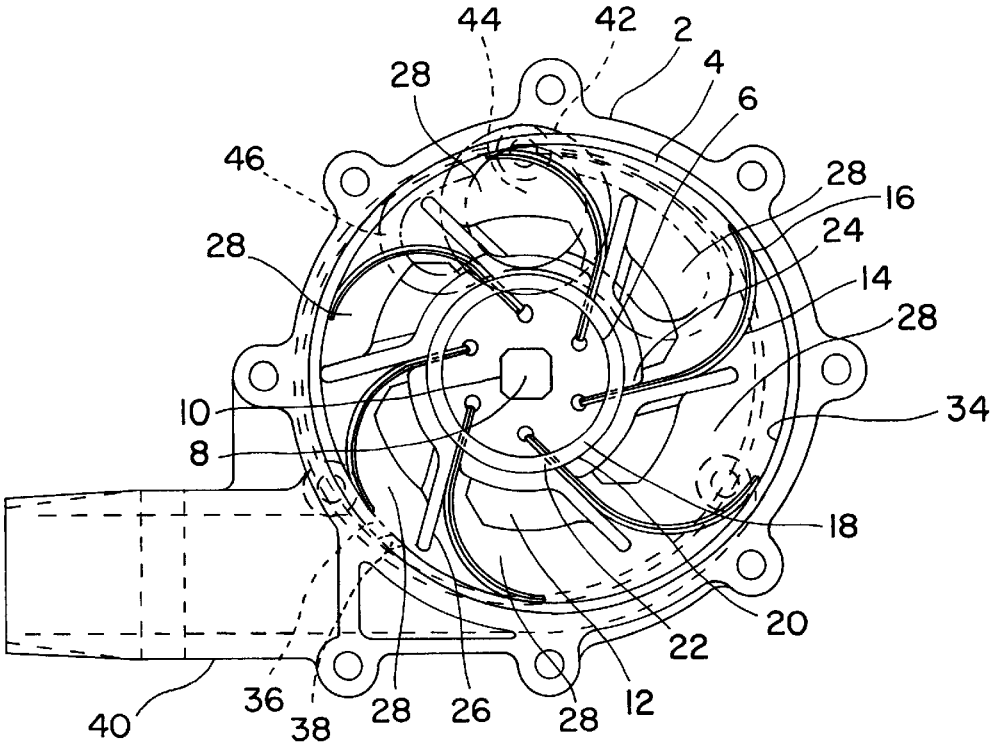
FIG. 2 is a front elevational view, in section, of the pump illustrated in FIG. 1.

Referring to FIGS. 1 and 2, a pump housing is designated by reference numeral 2, and a generally cylindrical sleeve designated by reference numeral 4 is inserted into the pump housing. A rotor, which is generally designated by reference numeral 6, is located within the sleeve 4. The central axis of the rotor, designated by drive shaft 8 received within square drive hole 10, is offset from the central axis of the rotor sleeve 4. As best illustrated by FIG. 1, the outer surface of the rotor 6, generally designated by reference numeral 12, is tapered outwardly in a direction away from the front (inlet) surface of the rotor to define an upwardly inclined outer surface on the rotor 6.

As best illustrated by FIG. 2, a plurality of flexible or resilient vanes, designated by reference numeral 14, extend radially outwardly from the rotor 6. The flexible vanes 14 are arranged relative to the rotor such that the remote ends of each flexible vane, designated by reference numeral 16, engage the inner surface of the rotor sleeve 4 as the rotor 6 rotates in the sleeve. Each flexible vane 14 is mounted to the rotor 6 by a retaining ring 18 received in an annular groove 20 defined in the outer periphery of the rotor 6. Notches 22 and slots 24 in the retaining ring 18 are provided to receive the proximal end of each flexible vane 14 for mounting the flexible vanes 14 to the rotor 6.

As also best illustrated by FIG. 2, a plurality of fixed vanes, designated by reference numeral 26, extend radially outwardly from the outer periphery of the rotor 6. Each of the fixed vanes 26 can be formed integrally with the rotor 6. The fixed vanes 26 provide support for the inner ends of respective adjacent flexible vanes 14. Additionally, as will be discussed herein, the rotating fixed vanes enhance the flow of fluid into the rotor from fluid inlet means coupled to the pump housing.

FIG. 2 also discloses that a plurality of compartments 28 are defined between adjacent flexible vanes 14. The remote ends of each of the flexible vanes 14 engage the inner surface 34 of the rotor sleeve 4 so that each of the compartments 28 is sealed. One of the fixed vanes 26 extends into each of the compartments 28. However, since the remote end of each fixed vane terminates before it engages the inner surface 34 of the rotor sleeve 4, fluid received in each of the compartments 28 can flow around the fixed vane 26 extending into the compartment. As will be discussed in great detail below, the volume of each of the compartments 28 varies as the rotor 6 rotates in the rotor sleeve 4 as a result of the offset orientation of the central axis of the rotor relative to the central axis of the rotor sleeve.

As best illustrated by FIG. 1, a front plate 30 is disposed over the front end of the rotor sleeve 4, and a rear plate 32 is disposed over the rear end of the rotor sleeve 4. The front and rear plates 30 and 32 are arranged to enclose the rotor 6 mounted within the rotor sleeve 4, as best illustrated by FIG. 2. As also shown by FIG. 2, the rotor 6 is mounted within the rotor sleeve 4 such that the central axis of the rotor is offset from the central axis of the rotor sleeve in which the rotor is mounted.

As illustrated by both FIGS. 1 and 2, a portion of the rotor sleeve 4 defines an outlet or discharge opening designated by reference numeral 36. At least one slot 38 is defined in the inner surface 34 of the rotor sleeve proximate to the outlet opening 36. As will be discussed further herein, the slots 38 feed fluid into the outlet opening 36 as a result of the action of the flexible vanes 14 when the rotor 6 rotates within the rotor sleeve. Discharge means, illustrated by discharge tube 40, is coupled in fluid flow relationship to the discharge opening 36 for receiving fluid discharges from the rotor sleeve during operation of the pump. As best shown by FIG. 2, the outlet opening 36 and the outlet tube 40 are in a substantially tangential orientation relative to the inner surface 34 of the rotor sleeve 4, and are also tangential to the slots 38 in the rotor sleeve which lead into the discharge outlet 36. In this manner, the discharge of material from the rotor sleeve is facilitated by the centrifugal forces of the rotating rotor acting on the discharged material to reduce the overall energy consumption required for operation of the pump.

As best illustrated by FIG. 1, a fluid inlet tube designated by reference numeral 42, defining a fluid inlet channel 44, is coupled in fluid flow relationship to the front (inlet) end of the rotor sleeve 4 of the pump housing 2. In this manner, the flow of fluid into the pump housing and rotor sleeve is along a plane which is oriented substantially perpendicular to the plane along which the rotor 6 rotates. The perpendicular orientation between the incoming fluid flow and the plane of rotation of the rotor results in energy efficient inlet flow of fluid into the pump housing and the rotor sleeve, thereby reducing the overall power consumption necessary to operate the pump.

Figure 4:
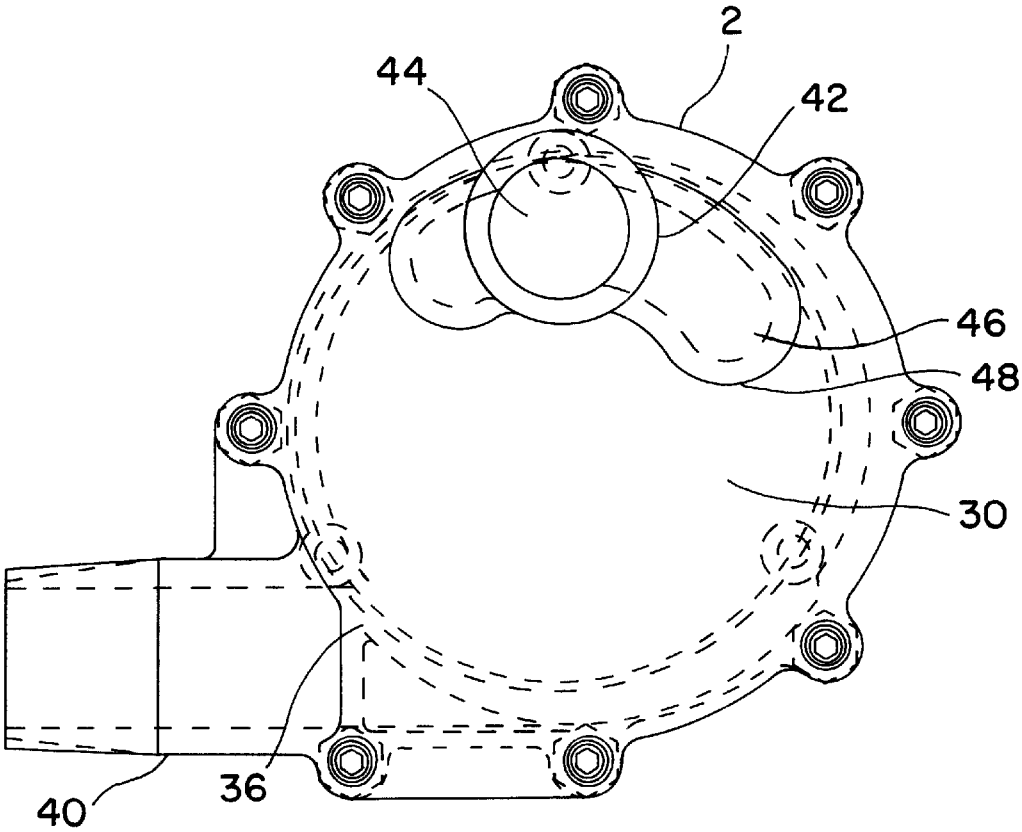
FIG. 4 is a front elevational view of the pump as illustrated by FIG. 2 in which a slotted inlet plate is shown disposed over the inlet end of the rotor sleeve.

As illustrated by FIGS. 1 and 2, and as best shown by FIG. 4, the front end plate 30 mounted over the inlet end of the rotor sleeve 4, defines an arcuate inlet slot designated by reference numeral 46. The discharge end of the inlet tube 42 is in fluid communication with the inlet slot 46 so that all fluid flowing from the inlet tube 42 into the inlet end of the rotor sleeve 4 must pass through the inlet slot 46. The relative arrangement of the inlet tube 42 and the inlet slot 46 controls the position at which incoming fluid first enters the rotor sleeve. As also shown by FIG. 4, the inlet end of the tube 42 abutting against the inlet slot 46 in the end plate 30, is itself mounted on a support plate which defines an arcuate recess 48 in substantial registration with the arcuate inlet slot 46. In this manner, inlet fluid flowing from the pipe 42 is more evenly distributed along the inlet slot 46 by the arcuate recess 48 so that the incoming fluid flows uniformly from the pipe 42 and into the rotor sleeve 4.

As shown by FIG. 1, a power source, such as an electric motor designated by reference numeral 50, is coupled to the rotor square drive shaft 8 for rotating the rotor 6 when the pump is in operation.

Figure 3:
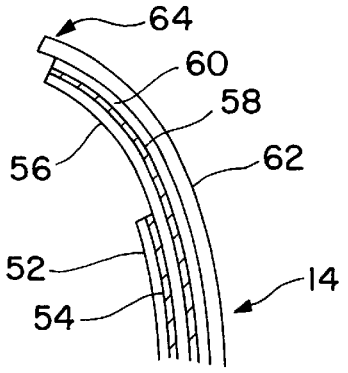
FIG. 3 illustrates, in section, a flexible vane in accordance with the present invention.

FIG. 3 illustrates, in detail, one of the plurality of flexible vanes 14 extending radially outwardly from the rotor 6, as best illustrated by FIG. 2. The flexible vane 14 is formed from a first inner leaf spring designated by reference numeral 52, and a plastic laminate 54 bonded to the outer surface of the spring 52. A second spring 56, which is longer in length than spring 52 and laminate 54, is mounted to the outer surface of the laminate 54. A second layer of plastic laminate, designated by reference numeral 58, is bonded to the outer surface of the spring 56, and a third spring 60, of the same length as spring 56, is mounted to the outer surface of the laminate layer 58. A shoe 62, longer in length than springs 56 and 60 and laminate layer 58, is mounted to the outer surface of spring 60. The outer surface of the remote end 64 of the shoe 62 is biased by springs 52, 56 and 58 to engage and directly contact the inner surface 34 of the rotor sleeve 4 when the rotor 6 is mounted in the rotor sleeve, as illustrated by FIG. 2. Preferably, the springs 52, 56 and 60 are stainless steel leaf springs, and the shoe 62 is formed from a high molecular weight polyethylene. The use of a plurality of different springs, some of which are of differing lengths, reduce stress and wear that would otherwise occur if the vane were formed from a single piece spring. Additionally, use of a plurality of different spring components provides backup in the event that one of the spring components fails. Accordingly, forming the flexible vane 14 from at least two separate spring components reduces stress and wear on the vane, thereby reducing the frequency of repair and replacement of the rotor and increasing its useful operating life.

In operation of the pump disclosed by FIGS. 1–4, incoming fluid, particularly liquid, is supplied through the inlet channel 44 of the inlet tube 42. The incoming fluid flows through the arcuate inlet slot 46 defined in the front end plate 30 disposed over the front (inlet) surface of the rotor sleeve 4 along a plane substantially perpendicular to the plane of rotation of the rotor. The rotor 6 has a central axis which is offset relative to the central axis of the rotor sleeve 4 such that the volume of the compartments 28, defined between adjacent flexible vanes 14, varies as the rotor 6 rotates in a predetermined direction of rotation in the rotor sleeve 4. The inlet slot 46 is arranged to introduce fluid into the rotor sleeve at a position therein in which the compartments 28 are at their smallest volume. Once fluid is initially introduced into a compartment in registration with the inlet slot 46, the compartment expands in volume as the rotor rotates from the leading end towards the trailing end of the slot 46 (i.e., in a clockwise direction as shown in FIG. 2.). As the expanding compartment 28 moves along the inlet slot 46, a partial vacuum is created in the compartment to draw additional material into the compartment. The suction created by the partial vacuum reduces the energy consumption by the pump necessary to draw incoming fluid into the rotor sleeve. Additionally, the fixed vanes 26 extending into each compartment 28 enhance the flow of fluid into the compartment, as does the upwardly inclined outer surface 12 of the rotor 6 in a direction away from the front (inlet) surface of the rotor. The cooperation between the partial vacuum created by the expanding chambers 28, the action of the fixed vane 26, and the inclined outer surface of the rotor 6, reduce the electrical energy requirement needed to draw fluid from the inlet tube 42 into the rotor sleeve 4 as the rotor rotates in the sleeve. The energy efficient operation of the pump is further enhanced as a result of the substantially perpendicular orientation of the direction of flow of incoming fluid through the inlet tube 42 and the plane of rotation of the rotor 4. Loading inflowing fluid into the compartments 28 defined between the flexible vanes 14 of the rotor in a perpendicular, not tangential, orientation, reduces the energy input required to fully load the compartments 28 with the incoming fluid by reducing obstruction to incoming fluid by the rotating vanes.

Still referring to FIG. 2 of the drawing, after a compartment 28 has been loaded with fluid and the trailing flexible vane 14 has rotated past the trailing edge of the inlet slot 46 (e.g., the right end of slot 46 in FIG. 2 when the rotor rotates in a clockwise direction), the compartment 28 becomes completely sealed by the opposed flexible vanes 14, the inner surface 34 of the rotor sleeve 4, the front wear plate 30, and the rear wear plate 32. As a result of the offset orientation between the rotor and the rotor sleeve, as the rotor continues to rotate (in a clockwise direction shown by FIG. 2), each compartment 28 reaches a maximum volume, and thereafter begins to contract in volume as the compartment approaches the outlet opening 36 in the rotor sleeve 4. The compressive forces applied to the fluid in the sealed compartment as the compartment continues to contract in volume supplements the energy required to efficiently discharge the fluid from the compartment, thereby further reducing the overall energy consumption necessary for the operation of the pump. Slots 38, defined in the inner surface 34 of the sleeve immediately prior to the discharge outlet 36 (when the rotor rotates in a clockwise direction as shown by FIG. 2) assist in uniformly and efficiently discharging fluid from each compartment 28 as the compartment rotates over the discharge outlet opening 36. The tangential orientation between the discharge opening 36 and the slots 38 relative to the inner surface 34 of the rotor sleeve 4 increases the efficiency of the discharge of fluid from the sleeve. The fluid discharged through the outlet opening 36 is received within a discharge tube 40 coupled in fluid communication to the discharge opening 36. Any small quantity of material not discharged from a compartment 28 through the discharge opening 36 tends to ride along the inner surface 34 of the rotor sleeve 4 as the rotor continues to rotate, thereby enhancing the seal between the compartment 28 and the rotor sleeve 4.

As the compartment 28 passes over the discharge outlet 36, the volume of the compartment continues to contract as a result of the offset relationship between the rotor and the rotor sleeve. The contraction of the compartment continues until the compartment approaches the leading edge of the inlet arcuate slot 46 (the leftmost end of the slot 46 as shown in FIG. 2 when the rotor rotates in a clockwise direction), at which point the volume of the chamber 28 is at its minimum. As the chamber continues to rotate across the inlet slot 46, it is again loaded with incoming fluid and the operating cycle described above is repeated.

A pump in accordance with the invention described herein requires less electrical energy for operation than that of comparable devices. The reduced energy requirement results from one or more from the several different structural and functional features described herein including the orientation of incoming fluid along a plane perpendicular to the plane of rotation of the rotor, the offset relationship between the rotor and rotor sleeve resulting in compartments of variable volume as the compartments rotate across an arcuate inlet loading slot, the outwardly increasing sidewall of the rotor in a direction away from the inlet end, and the slots defined in the rotor sleeve positioned forward of an outlet discharge opening oriented tangentially relative to the inner surface of the rotor sleeve for uniformly discharging fluid from the rotor sleeve. A pump in accordance with the present invention also has a useful operating life exceeding that of comparable devices as a result of the employment of flexible vanes formed from more than a single spring component.

The pump in accordance with the present invention also includes means for preventing damage from fluid pressure exceeding a predetermined operating level. In the event that the fluid pressure in each of the compartments 28 exceeds a predetermined operating level, the excess pressure will cause the free ends 16 of the flexible vanes 14 to disengage from the inner surface 34 of the rotor sleeve 4. When this occurs, the compartments 28 are no longer sealed and fluid will no longer be forced from the compartments through the discharge outlet 36 as the rotor continues to rotate in the rotor sleeve. Once the fluid pressure in the compartments 28 is decreased below the predetermined operating level, the resilient bias on the flexible vanes 14 overcomes the fluid pressure acting on the flexible vanes, and the free ends 16 of the vanes 14 re-engage against the inner surface 34 of the rotor sleeve 4. When this occurs, the compartments 28 are again sealed, fluid in the compartments is discharged as the compartments rotate over the discharge outlet 36, and the pumping operation is resumed. The predetermined fluid pressure which causes the pump to cease operation is controlled by the resilient characteristic of the flexible vanes 14 and therefore can be adjusted by replacing the rotor with a different rotor having vanes of a different resilient characteristic.

In the preferred embodiments of the invention, the resilient elements of the flexible vanes are leaf springs, preferably formed from stainless steel, and the shoe element of the flexible vane is preferably formed from a plastic material, and in particular, polypropylene or an ultra high molecular weight polyethylene. Preferably the rotor, the fixed vanes of the rotor, and the rotor housing are formed from a durable plastic material. The cylindrical sleeve within the rotor housing, and the front and rear end plates disposed over the front and rear ends of the rotor sleeve, preferably are formed from a metallic material, such as stainless steel, but may also be formed from a ceramic material for special operations (such as when fluid flowing through the pump comprises an abrasive material).

Other variations and modifications of the invention disclosed herein will become apparent to those skilled in the art. Accordingly, the description of the preferred embodiments are intended to be illustrative only, but not restrictive of the scope of the invention, that scope being defined by the following claims and all equivalents thereto.

What is claimed is:

1. A pump comprising:

a rotor housing;

a rotor mounted in said rotor housing for rotation therein along a predetermined plane of rotation;

said rotor housing defining an inlet end adapted to be coupled in fluid flow relationship to fluid inlet means for introducing fluid into said rotor housing;

said inlet end of said rotor housing being arranged relative to said fluid inlet means such that the flow of fluid into said rotor housing is along a plane substantially perpendicular to said predetermined plane of rotation of said rotor;

said rotor defining an outer surface tapering outwardly in a direction away from said inlet end of said rotor housing.

2. The pump as claimed in claim 1 wherein said rotor housing defines an outlet opening therein, said outlet opening being oriented substantially tangential to said predetermined plane of rotation of said rotor.

3. The pump as claimed in claim 2 wherein at least one slot is defined in an inner surface of said rotor housing at a location on said rotor housing positioned in advance of said outlet opening in said rotor housing when said rotor rotates in a predetermined direction of rotation.

4. The pump as claimed in claim 3 wherein one end of said at least one slot terminates proximate to said outlet opening such that fluid rotating with said rotor is guided through said at least one slot and into said outlet opening for discharge from said rotor housing.

5. A pump comprising:

a rotor housing;

a rotor mounted in said rotor housing for rotation therein along a predetermined plane of rotation;

said rotor housing defining an inlet end adapted to be coupled in fluid flow relationship to fluid inlet means for introducing fluid into said rotor housing;

said inlet end of said rotor housing being arranged relative to said fluid inlet means such that the flow of fluid into said rotor housing is along a plane substantially perpendicular to said predetermined plane of rotation of said rotor;

wherein said rotor is mounted in said rotor housing such that a central axis of said rotor is offset from a central axis of said rotor housing.

6. The pump as claimed in claim 5 wherein said rotor includes a plurality of vanes; each of said vanes being formed, at least in part, from a resilient material; each of said vanes having a first end attached to said rotor and a second end extending outwardly from said rotor and engaging an inner surface of said rotor housing.

7. The pump as claimed in claim 6 wherein said plurality of vanes are arranged such that a compartment is defined between each of two successive adjacent vanes and said inner surface of said rotor housing.

8. The pump as claimed in claim 7 wherein said compartment defined between said two adjacent vanes is variable in volume as said rotor rotates in said rotor housing as a result of the offset orientation between said central axis of said rotor and said central axis of said rotor housing.

9. The pump as claimed in claim 8 including means cooperating with said inlet end of said rotor housing for introducing fluid from said fluid inlet means into said rotor housing at a predetermined location of said rotor housing at which said compartments defined between said adjacent vanes are at their smallest volume.

10. The pump as claimed in claim 9 wherein said means cooperating with said inlet end of said rotor housing includes a plate mounted to said inlet end of said rotor housing, said plate defining an opening therein in registration with said predetermined location of said rotor housing.

11. The pump as claimed in claim 9 wherein said vanes formed in part from said resilient material are arranged and oriented relative to said rotor housing such that the volume of each of said compartments defined between successive adjacent vanes increases as each of said compartments rotates with said rotor in a predetermined direction of rotation between a front end and a rear end of said means cooperating with said inlet end of said rotor housing to create a partial vacuum in each of said compartments.

12. The pump as claimed in claim 11 wherein each of said compartments decreases in volume as said compartments rotate with said rotor in said predetermined direction of rotation between said means cooperating with said inlet end of said rotor housing and said outlet opening in rotor housing.

13. A pump comprising:

a rotor housing;

a rotor mounted in said rotor housing for rotation therein along a predetermined plane of rotation;

said rotor housing defining an inlet end adapted to be coupled in fluid flow relationship to fluid inlet means for introducing fluid into said rotor housing;

said inlet end of said rotor housing being arranged relative to said fluid inlet means such that the flow of fluid into said rotor housing is along a plane substantially perpendicular to said predetermined plane of rotation of said rotor;

the pump as claimed in claim 1 wherein said rotor is mounted in said rotor housing such that a central axis of said rotor is offset from a central axis of said rotor housing;

said rotor including a plurality of vanes; each of said vanes being formed, at least in part, from a resilient material; each of said vanes having a first end attached to said rotor and a second end extending outwardly from said rotor and engaging an inner surface of said rotor housing;

wherein said rotor includes a fixed vane disposed between each of said two successive adjacent resilient vanes; each of said fixed vanes having a remote end extending outwardly from said rotor, said remote end terminating prior to said inner surface of said rotor housing.

14. A pump comprising:

a rotor housing, a rotor mounted for rotation along a predetermined plane of rotation in said rotor housing;

said rotor being mounted in said rotor housing such that a central axis of said rotor is offset from a central axis of said rotor housing;

said rotor housing having a plurality of vanes extending outwardly therefrom; each of said plurality of vanes being formed, at least in part, from a resilient material; each of said plurality of vanes having a remote end engaging an inner surface of said rotor housing;

said rotor housing having an inlet end adapted to be coupled in fluid communication with fluid inlet means;

said rotor having an outer surface which is tapered outwardly in a direction away from said inlet end of said rotor housing.

15. The pump as claimed in claim 14 wherein said rotor is oriented relative to said rotor housing such that fluid flowing into said inlet end of said rotor housing flows along a plane oriented substantially perpendicular to said predetermined plane of rotation of said rotor; and said rotor housing defines an outlet opening which is oriented substantially tangential to said predetermined plane of rotation of said rotor.

16. A pump as claimed in claim 15 wherein said inner surface of said rotor housing defines at least one slot located in advance of said outlet opening when said rotor rotates in a predetermined direction of rotation in said rotor housing, said slot oriented relative to said outlet opening for discharging fluid carried by said rotating rotor through said outlet opening.

17. A vane for use in a pump, said vane adapted to extend from a rotor mounted for rotation within a rotor housing, said vane having a remote end adapted to engage an inner surface of said rotor housing, said vane comprising at least two separate resilient elements.

18. The vane as claimed in claim 17 wherein said first resilient element is a first leaf spring, said second resilient element is a second leaf spring, and at least one layer of laminate is disposed between said first and second leaf springs.

19. The vane as claimed in claim 18 further including a shoe element carried by said first and second leaf springs, said first and second leaf springs and said shoe being arranged such that at least a portion of said shoe engages the inner surface of said rotor housing when said rotor rotates in said rotor housing.

* * * * *